US011898762B2

(12) United States Patent
Noguchi

(10) Patent No.: US 11,898,762 B2
(45) Date of Patent: Feb. 13, 2024

(54) CEILING-EMBEDDED AIR CONDITIONER

(71) Applicant: FUJITSU GENERAL LIMITED, Kanagawa (JP)

(72) Inventor: Hiroaki Noguchi, Kanagawa (JP)

(73) Assignee: FUJITSU GENERAL LIMITED, Kanagawa (JP)

( * ) Notice: Subject to any disclaimer, the term of this patent is extended or adjusted under 35 U.S.C. 154(b) by 728 days.

(21) Appl. No.: 17/040,178

(22) PCT Filed: Jan. 22, 2019

(86) PCT No.: PCT/JP2019/001788
§ 371 (c)(1),
(2) Date: Sep. 22, 2020

(87) PCT Pub. No.: WO2019/187536
PCT Pub. Date: Oct. 3, 2019

(65) Prior Publication Data

US 2021/0010686 A1 Jan. 14, 2021

(30) Foreign Application Priority Data

Mar. 30, 2018 (JP) ..... 2018-069616

(51) Int. Cl.
*F24F 1/0047* (2019.01)
*F24F 1/0022* (2019.01)
*F24F 13/20* (2006.01)

(52) U.S. Cl.
CPC ..... *F24F 1/0047* (2019.02); *F24F 1/0022* (2013.01); *F24F 13/20* (2013.01)

(58) Field of Classification Search
CPC ..... F24F 13/20; F24F 1/0047; F24F 1/0022; F24F 2221/14
See application file for complete search history.

(56) References Cited

U.S. PATENT DOCUMENTS 4,458,502 A * 7/1984 Adachi ..... F24F 1/0057 62/263
2007/0116559 A1* 5/2007 Higashida ..... F24F 1/0047 415/206

(Continued)

FOREIGN PATENT DOCUMENTS

CN 101802509 A 8/2010
CN 102147130 A 8/2011

(Continued)

OTHER PUBLICATIONS

International Search Report, dated Mar. 26, 2019 by the Japan Patent Office (JPO), in International Application No. PCT/JP2019/001788.

(Continued)

*Primary Examiner* — Nelson J Nieves
(74) *Attorney, Agent, or Firm* — GREENBLUM & BERNSTEIN, P.L.C.

(57) ABSTRACT

A ceiling-embedded air conditioner includes a main unit, and a decorative panel that has an intake port and an outlet guide tube, wherein the main unit includes a box-shaped housing, a heat exchanger that is disposed inside the housing, a fan unit that is disposed inside the housing and collects air from the intake port and discharge the air from an outlet tube, and a drain pan that has an outlet port opening through which the air discharged from the outlet tube passes toward the outlet guide tube, the outlet guide tube has a top opening communicating with the outlet tube, a bottom opening facing a direction below a front plate of the housing, and a curved outlet ventilation path connecting the top opening to the bottom opening, and a bottom end of the bottom opening protrudes more downwards than the decorative panel does.

3 Claims, 9 Drawing Sheets

(56) References Cited

U.S. PATENT DOCUMENTS

| | | | | |
|---|---|---|---|---|
| 2007/0256816 | A1* | 11/2007 | Higashida | F24F 13/20 165/120 |
| 2010/0192611 | A1 | 8/2010 | Yamaguchi et al. | |
| 2011/0240255 | A1 | 10/2011 | Sakashita | |
| 2015/0121943 | A1* | 5/2015 | Ishino | F24F 13/20 62/426 |
| 2015/0323218 | A1* | 11/2015 | Terano | F24F 13/30 165/173 |
| 2017/0067681 | A1 | 3/2017 | Kim et al. | |
| 2017/0276396 | A1* | 9/2017 | Azumi | F24F 1/0047 |
| 2019/0368751 | A1* | 12/2019 | Seki | F24F 1/0011 |
| 2020/0049371 | A1* | 2/2020 | Yamaguchi | F24F 1/0047 |
| 2020/0056799 | A1* | 2/2020 | Tomoigawa | F24F 1/00077 |
| 2020/0063984 | A1* | 2/2020 | Sawai | F24F 13/20 |
| 2020/0124295 | A1* | 4/2020 | Kawamura | F24F 1/0063 |
| 2020/0309405 | A1* | 10/2020 | Jang | F24F 13/081 |

FOREIGN PATENT DOCUMENTS

| | | | | |
|---|---|---|---|---|
| EP | 2 378 217 | A1 | 10/2011 | |
| EP | 2 775 226 | A2 | 9/2014 | |
| EP | 3 115 709 | A2 | 1/2017 | |
| JP | H05-332568 | A | 12/1993 | |
| JP | H06-221611 | A | 8/1994 | |
| JP | 2000-213767 | A | 8/2000 | |
| JP | 2010043843 | A * | 2/2010 | F24F 1/0007 |
| JP | 2018-119714 | A | 8/2018 | |
| JP | 2018-119718 | A | 8/2018 | |

OTHER PUBLICATIONS

Written Opinion, dated Mar. 26, 2019 by the Japan Patent Office (JPO), in International Application No. PCT/JP2019/001788.

Extended European Search Report (EESR), dated Dec. 6, 2021, in the corresponding European Patent Application No. 19776797.3.

Chinese Notice of First Office Action (including English Language Machine Translation), dated Apr. 21, 2021 by The State Intellectual Property Office of The People's Republic of China, for Chinese Patent Application No. 201980021150.1.

* cited by examiner

A-A SECTION

C-C SECTION

CEILING-EMBEDDED AIR CONDITIONER

FIELD

The present invention relates to a ceiling-embedded air conditioner.

BACKGROUND

A ceiling-embedded air conditioner (indoor unit) installed behind the ceiling of an air-conditioned room is connected to an outdoor unit that is installed outdoor through a refrigerant line, to forms a refrigerant circuit. The ceiling-embedded air conditioner includes a box-shaped main unit that is installed behind the ceiling, and a decorative panel that covers the bottom surface of the main unit, and that is exposed from the ceiling surface.

FIG. 11 illustrates a conventional ceiling-embedded air conditioner. 10 denotes to a main unit, and 20 denotes to a decorative panel having an intake port 21, and an outlet port 23 provided with wind deflectors 22. The main unit 10 is surrounded by a housing 11 the top side and the lateral sides of which are made of steel plates. Provided inside the main unit 10 are a sirocco fan 12 that sucks the air from the intake port 21 provided to the decorative panel 20, a fan casing 13 in which the sirocco fan 12 is housed, a heat exchanger 14 that has a V shape rotated by 90 degrees, and against which the wind coming out of the sirocco fan 12 and guided by the fan casing 13 blows, a drain pan 15 that collects dew drops formed on the heat exchanger 14, and an outlet guide 16 that changes the direction of the airflow passed through the heat exchanger 14, from a horizontal direction to a downward direction, and that guides the air to the outlet port 23 of the decorative panel 20.

FIG. 12 illustrates another conventional ceiling-embedded air conditioner. 30 denotes to a main unit, and 40 denotes to a decorative panel having an intake port 41 and an output port 43 that is provided with wind deflectors 42. The main unit 30 is surrounded by a housing 31 the top side and the lateral sides of which are made of steel plates. Provided inside the main unit 30 are a heat exchanger 32 folded by an angle of 170 degrees or so, and diagonally positioned near the intake port 41 of the decorative panel 40, a sirocco fan 33 that sucks the air from the intake port 41 via the heat exchanger 32, a drain pan 34 that collects the dew drops formed on the heat exchanger 32, and an outlet guide 35 that changes the direction of the airflow coming of the sirocco fan 33 from a horizontal direction to a downward direction, and that guides the air to an output port 43 of the decorative panel 40.

SUMMARY

Technical Problem

The conventional ceiling-embedded air conditioners explained with reference to FIGS. 11 and 12 have a structure in which an outlet ventilation path 16*a* extending along the outlet guide 16 to the outlet port 23 or an outlet ventilation path 35*a* extending along the outlet guide 35 to the output port 43 opens straight downwards, and the direction of the wind is changed to the frontward direction (toward the right in FIGS. 11, 12) using the use of the wind deflectors 22 provided to the outlet port 23 or the wind deflectors 42 provided to the output port 43. Therefore, as the wind deflectors 22, 24 change the direction of the wind, the direction is changed sharply, and the flow velocity of the wind drops quickly, and such sudden changes make it difficult to extend the reachable distance of the wind in the frontward direction.

An object of the present invention is to provide a ceiling-embedded air conditioner capable of alleviating a drop in the flow velocity of the outgoing air flow, and extending the reachable distance of the outgoing air flow in the frontward direction.

Solution to Problem

According to an aspect of embodiment, a ceiling-embedded air conditioner includes a main unit, and a decorative panel that has an intake port and an outlet guide tube and is mounted on a bottom surface of the main unit, wherein the main unit includes a box-shaped housing that has a top plate, a front plate, a rear plate, a left plate, and a right plate, a heat exchanger that is disposed inside the housing, a fan unit that is disposed inside the housing and includes a sirocco fan configured to collect air from the intake port and discharge the air from an outlet tube, and a drain pan that is configured to collects dew drops formed on the heat exchanger and has an outlet port opening through which the air discharged from the outlet tube of the sirocco fan passes toward the outlet guide tube of the decorative panel, the outlet guide tube of the decorative panel has: a top opening that communicates with the outlet tube of the sirocco fan through the outlet port opening of the drain pan, a bottom opening that faces a direction below the front plate of the main unit, and an outlet ventilation path that connects the top opening to the bottom opening and is curved, and a bottom end of the bottom opening protrudes more downwards than the decorative panel does.

The invention according to claim 2 is the ceiling-embedded air conditioner according to claim 1, wherein in the decorative panel, the intake port is covered by a grill, and a portion of the decorative panel between the grill and the bottom end of the bottom opening of the outlet guide tube protrudes downwards.

The invention according to claim 3 is the ceiling-embedded air conditioner according to claim 1 or 2, wherein an opening plane of the bottom opening of the outlet guide tube faces diagonally downwards toward a front.

Advantageous Effects of Invention

According to the present invention, because the bottom opening of the outlet guide tube faces a direction below the front plate of the main unit, because the outlet ventilation path connecting the top opening to the bottom opening is curved, and because the bottom end of the bottom opening protrudes more downwards than the decorative panel does, the wind coming out of the fan unit is gently guided downwards toward the front, by the outlet ventilation path having a curved outlet guide tube, without changing the direction of the wind in up-and-down directions using up-and-down wind deflectors. Therefore, it is possible to alleviate a drop in the flow velocity of the outgoing air, and to extend its reachable distance in the frontward direction.

DESCRIPTION OF EMBODIMENTS

Figure 1:
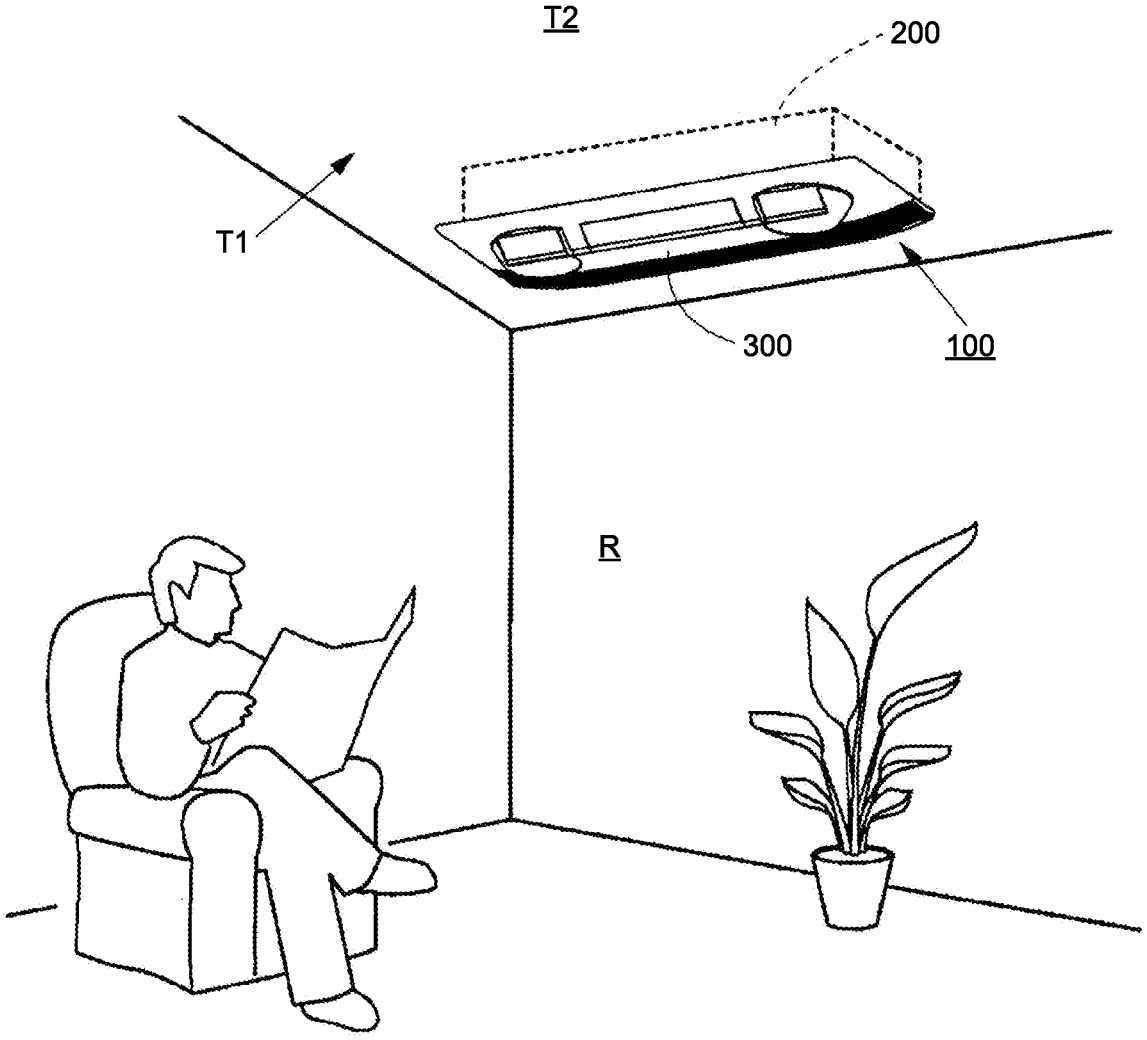
FIG. 1 is a schematic illustrating an installation of a ceiling-embedded air conditioner according to an embodiment of the present invention.
Figure 2:
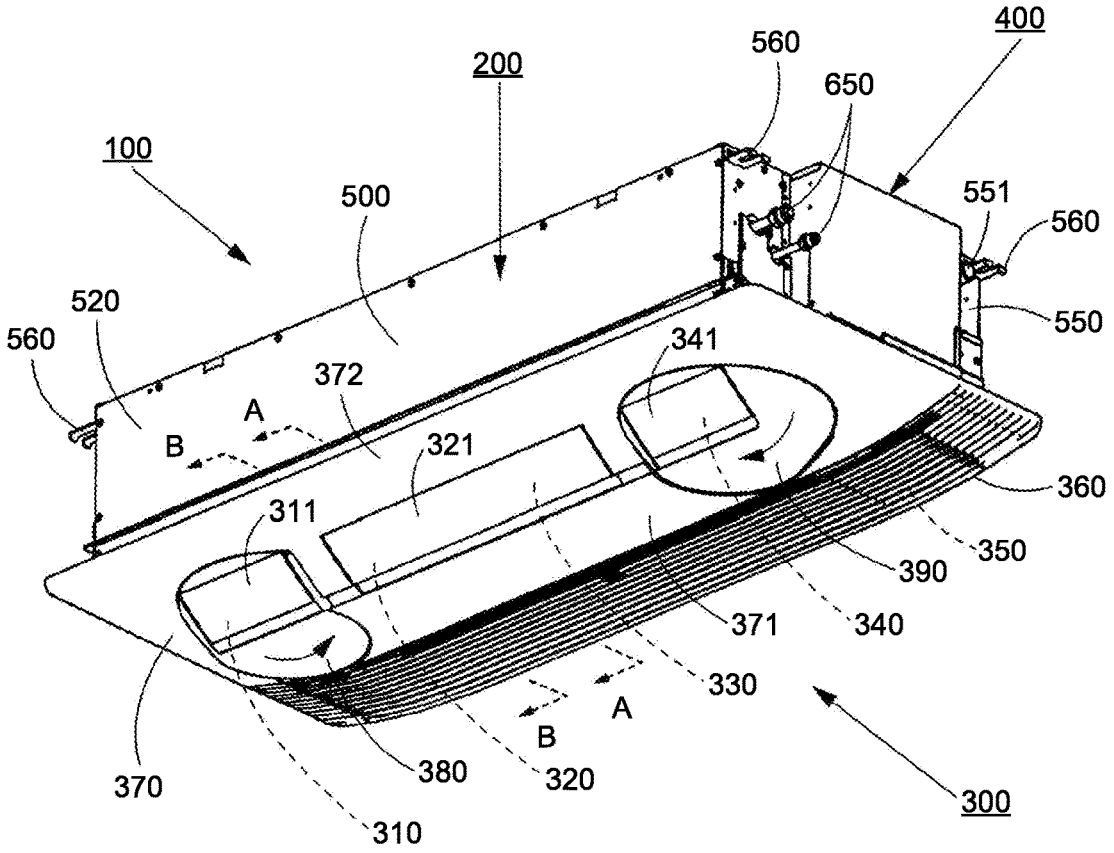
FIG. 2 is a perspective view illustrating the ceiling-embedded air conditioner in FIG. 1.

A ceiling-embedded air conditioner 100 according to an embodiment of the present invention will now be explained. This ceiling-embedded air conditioner 100 is mounted on a ceiling T1 of the air-conditioned room R, as illustrated in FIG. 1, and is connected to an outdoor unit, not illustrated, installed outdoor through a refrigerant line, to form a refrigerant circuit. The ceiling-embedded air conditioner 100 includes a box-shaped main unit 200 that is installed in a garret T2, and a decorative panel 300 that is mounted on the bottom surface of the main unit 200, in a manner exposed to the air-conditioned room R. The main unit 200 has an electrical equipment box 400 having a control board mounted on a side surface, as illustrated in FIG. 2.

Outlet guide tubes 310, 320, 330, 340 are provided as outlet ports, from the left to the right, on the front side of the decorative panel 300. The outgoing direction of the wind in the up-and-down directions can be adjusted by adjusting the wind passing through the leftmost outlet guide tube 310 using the outlet guide tube 310 and an up-and-down wind deflector 311 rotating with a leftmost rotating plate 380; adjusting the wind passing through the center outlet guide tubes 320, 330 using a shared up-and-down wind deflector 321; and adjusting the wind passing through the rightmost outlet guide tube 340 using the outlet guide tube 340 and an up-and-down wind deflector 341 rotating with a rightmost rotating plate 390. The rotating plate 380 is provided rotatably toward the left by 90 degrees from the position illustrated in FIG. 2, and the rotating plate 390 is provided rotatably toward the right by 90 degrees from the position illustrated in FIG. 2.

Behind the line along which the outlet guide tubes 310, 320, 330, 340 are aligned on a bottom surface 370 of the decorative panel 300 (the surface facing the air-conditioned room R illustrated in FIG. 1), an intake port 350 having an elongated shape in a left-to-right direction is provided, and the intake port 350 is covered by a grill 360. A protruding portion 371 protruding downwards, in the manner to be described later, is provided between the grill 360 and the up-and-down wind deflectors 311, 321, and 341, within a section between the grill 360 and a front part 372 of the bottom surface 370 of the decorative panel 300, and protrudes more downwards than the front part 372 does.

Figure 3:
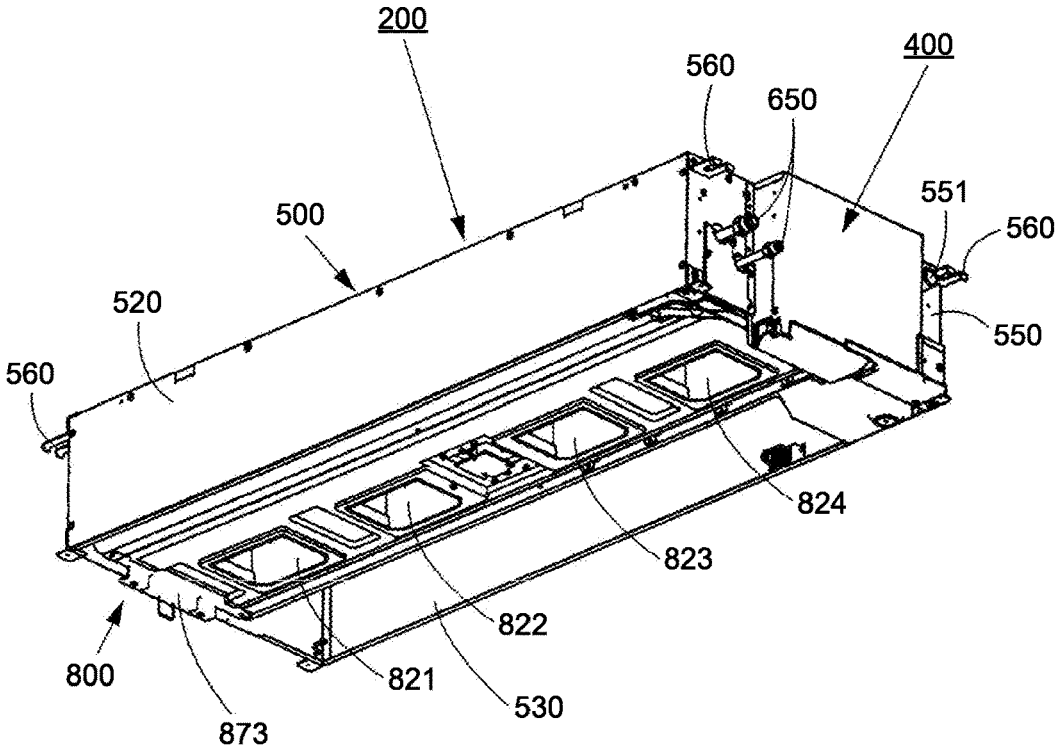
FIG. 3 is a perspective view of a main unit of the ceiling-embedded air conditioner illustrated in FIG. 2.
Figure 4:
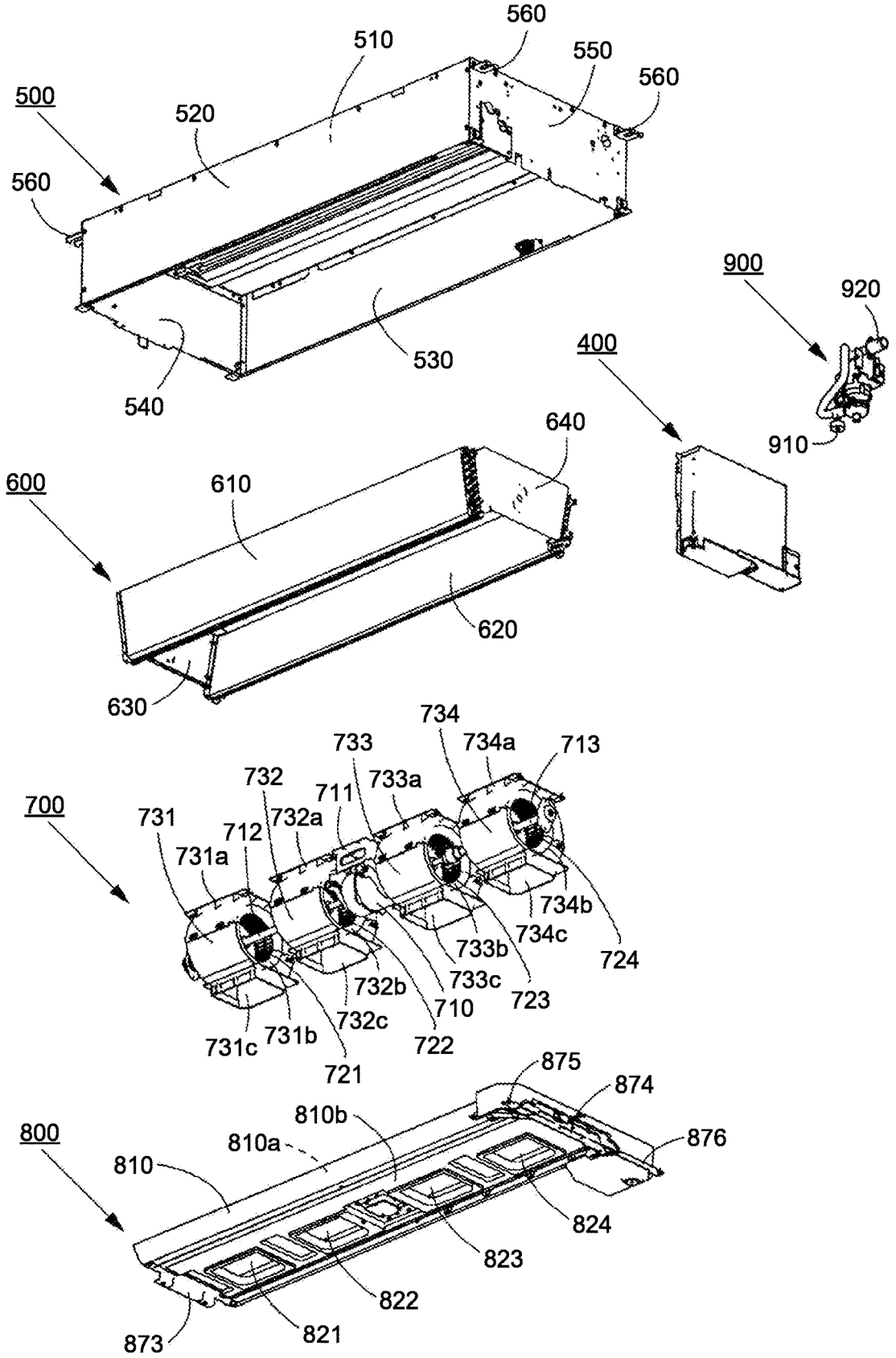
FIG. 4 is an exploded perspective view of the main unit in FIG. 3.

FIG. 3 illustrates a view of the main unit 200 with the decorative panel 300 removed, in a direction looking up from below, and FIG. 4 illustrates an exploded view of the main unit 200 in the direction looking up from below. The main unit 200 includes, in addition to the electrical equipment box 400, a housing 500 made of a steel plate, a heat exchanger 600, a fan unit 700, a drain pan 800, and a drain pump 900 having an intake port 910 and a discharge port 920.

The housing 500 has a box-like shape having a top plate 510 that has a rectangular shape, and a front plate 520, a rear plate 530, a left plate 540, and a right plate 550 that extend from the respective four sides of the top plate 510. The electrical equipment box 400 illustrated in FIG. 2 is mounted on the right plate 550, and a drainpipe 551 is attached to the same right plate 550. Two attachment clamps 560 are mounted on each of the left plate 540 and the right plate 550, on the side facing the top plate 510. The main unit 200 is installed in the garret T2, by having the attachment clamps 560 suspended from suspension bolts, not illustrated, that are fixed in the garret T2.

The heat exchanger 600 is housed in the housing 500, and includes a first heat exchanger 610 disposed near the front plate 520 of the housing 500, and a second heat exchanger 620 disposed near the rear plate 530. The first heat exchanger 610 is inclined in such a manner that the upper side thereof is positioned near the front plate 520 of the housing 500, and the second heat exchanger 620 is inclined in such a manner that the upper side thereof is positioned near the rear plate 530 of the housing 500. These heat exchangers 610, 620 have their top ends attached to the top plate 510 of the housing 500. A motor shaft support plate 630 supporting a motor rotational shaft 712, which will be described later, is attached to ends of the heat exchangers 610, 620, the ends being those on the side facing the left plate 540, and a motor shaft support plate 640 supporting a motor rotational shaft 713, which will be described later, is attached to ends of the heat exchangers 610, 620, the ends being those on the side facing the right plate 550.

The fan unit 700 includes a double-shaft fan motor 710 having a motor mount 711, two impellors 721, 722 that are fixed to one motor rotational shaft 712 of the fan motor 710, two impellors 723, 724 that are fixed to the other motor rotational shaft 713 of the fan motor 710, and fan casings 731 to 734 that cover the respective impellors 721 to 724. Each of the fan casings 731 to 734 includes a top mount 731*a* to 734*a* to be attached to the top plate 510 of the housing 500, an intake opening 731*b* to 734*b* provided on one side surface, and an outlet tube 731*c* to 734*c* provided in a manner protruding downwards. Each pair of the impellor 721 and the fan casing 731, the impellor 722 and the fan casing 732, the impellor 723 and the fan casing 733, and the impellor 724 and the fan casing 734 forms a sirocco fan.

Figure 5:
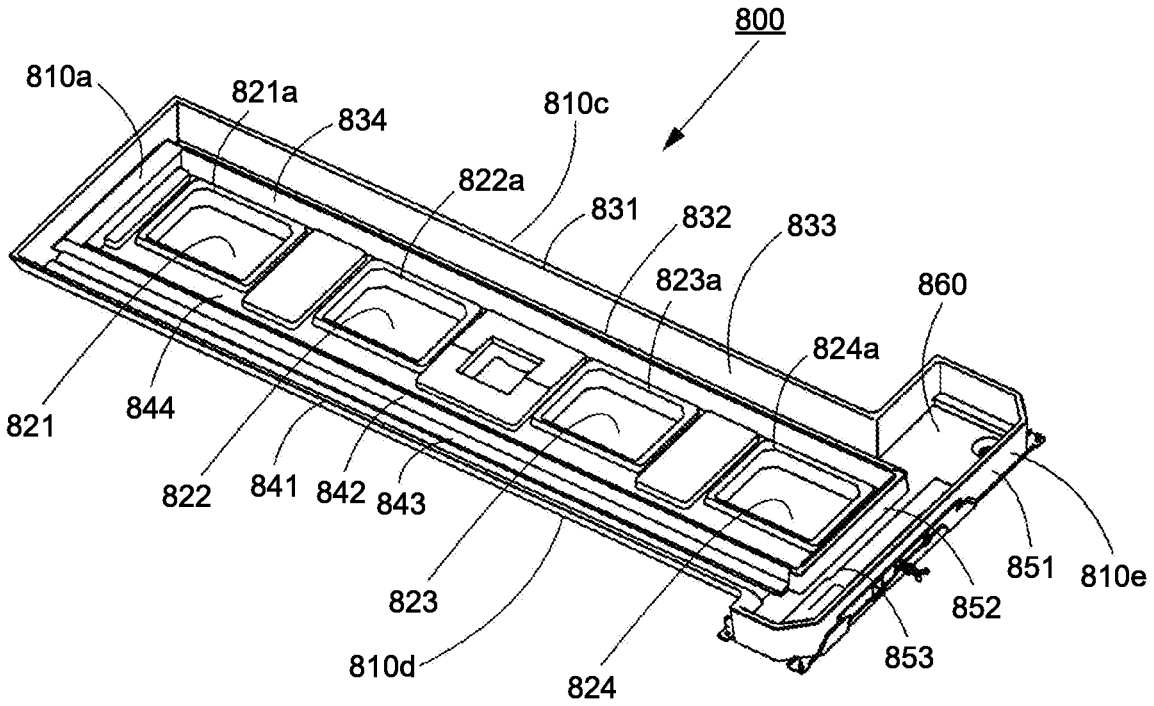
FIG. 5 is a perspective view of a top side of a drain pan.

The drain pan 800 is made from an insulator material 810 made of polystyrene foam. This insulator material 810 has four outlet port openings 821 to 824 passing through a top surface 810*a* to a bottom surface 810*b* thereof, provided in a manner arranged along a line. The drain pan 800 has a substantially rectangular shape having a rear end 810*c* and a front end 810*d* thereof as its long sides, as illustrated in FIG. 5.

The top surface 810*a* of the insulator material 810 is provided with a groove 833 that receives the dew drops formed on the second heat exchanger 620 and is formed between an outer wall 831 on the side of the rear end 810*c* and an inner wall 832 on the rear side. A groove 843 configured to receive the dew drops formed on the first heat exchanger 610 is formed between an outer wall 841 on the side of the front end 810*d*, and an inner wall 842 on the front side. A groove 853 is also provided between an outer wall 851 on the side of a right end 810*e*, and an inner wall 852 on the right side. A groove 834 serving as a drain pan configured to receive the dew drops attached to the outside of the fan casings 731 to 734 is also provided between the inner wall 832 and side walls 821*a* to 824*a* of the outlet port openings 821 to 824. A groove 844 serving as a drain pan configured to receive the dew drops attached to the outside of the fan casings 731 to 734 is also provided between the inner wall 842 and side walls 821*a* to 824*a* of the outlet port openings 821 to 824. A drain tank 860 is provided at the rear right on the top surface 810*a* of the insulator material 810. The groove 833 and the groove 853 are continuous to the drain tank 860, and the groove 843 is continuous to the groove 853. In other words, the drain water collected into the grooves 833, 843, 853 are further collected into the drain tank 860. The grooves 834, 844 do not communicate with the grooves 833, 843.

Figure 6:
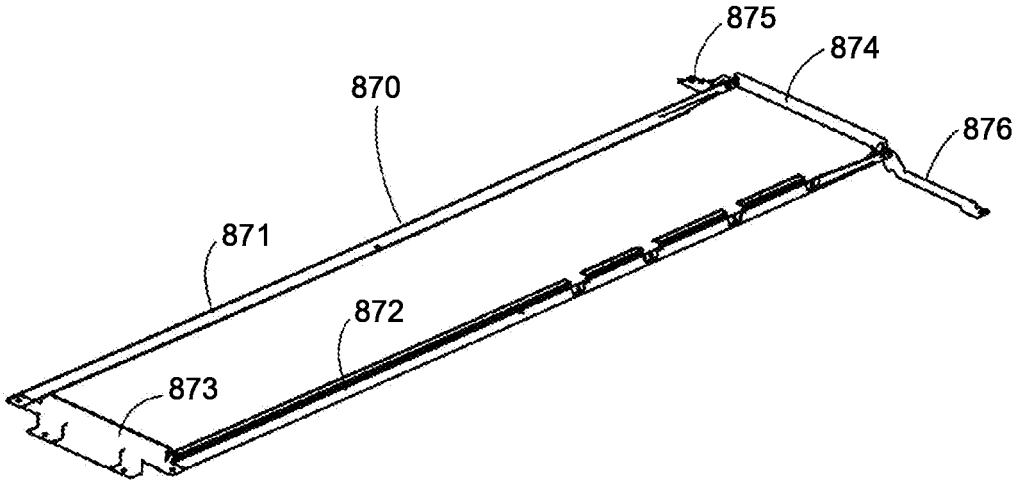
FIG. 6 is a perspective view of a reinforcement metal piece.

On the side of the bottom surface 810*b* of the insulator material 810, a reinforcement metal piece 870 having the shape illustrated in FIG. 6 is mounted, by embedding. The reinforcement metal piece 870 has a long piece 871 corresponding to the rear end 810*c* of the drain pan 800, a long piece 872 corresponding to the front end 810*d*, a short piece 873 connecting the left ends of the long piece 871 and the long piece 872 in FIG. 6, a short piece 874 connecting the right ends of the long piece 871 and the long piece 872 in FIG. 6, and attachment pieces 875, 876. The entire shape of the reinforcement metal piece 870 is a rectangular shape surrounding the outside of the outlet port openings 821 to 824 provided to the drain pan 800, with the rectangular shape delineated by the long pieces 871, 872 and the short pieces 873, 874. To embed the reinforcement metal piece 870 in the insulator material 810, the reinforcement metal piece 870 is positioned inside a mold for forming the insulator material 810 in advance, and polystyrene foam is then caused to foam so that the reinforcement metal piece 870 is embedded therein. In this manner, the reinforcement metal piece 870 is integrated with the insulator material 810 in such a manner that the long piece 871, 872 are embedded in the insulator material 810, with the short pieces 873, 874 and the attachment pieces 875, 876 exposed.

The outlet guide tube 310 of the decorative panel 300 is provided communicatively with the outlet port opening 821 of the drain pan 800, and the outlet guide tube 320 is provided communicatively with the outlet port opening 822 of the drain pan 800. The outlet guide tube 330 is provided communicatively with the outlet port opening 823 of the drain pan 800, and the outlet guide tube 340 is provided communicatively with the outlet port opening 824 of the drain pan 800. The up-and-down wind deflector 311 in the leftmost outlet guide tube 310 and the up-and-down wind deflector 341 in the rightmost outlet guide tube 340 are rotationally adjustable by an angle of 90 degrees, as mentioned earlier.

Figure 7:
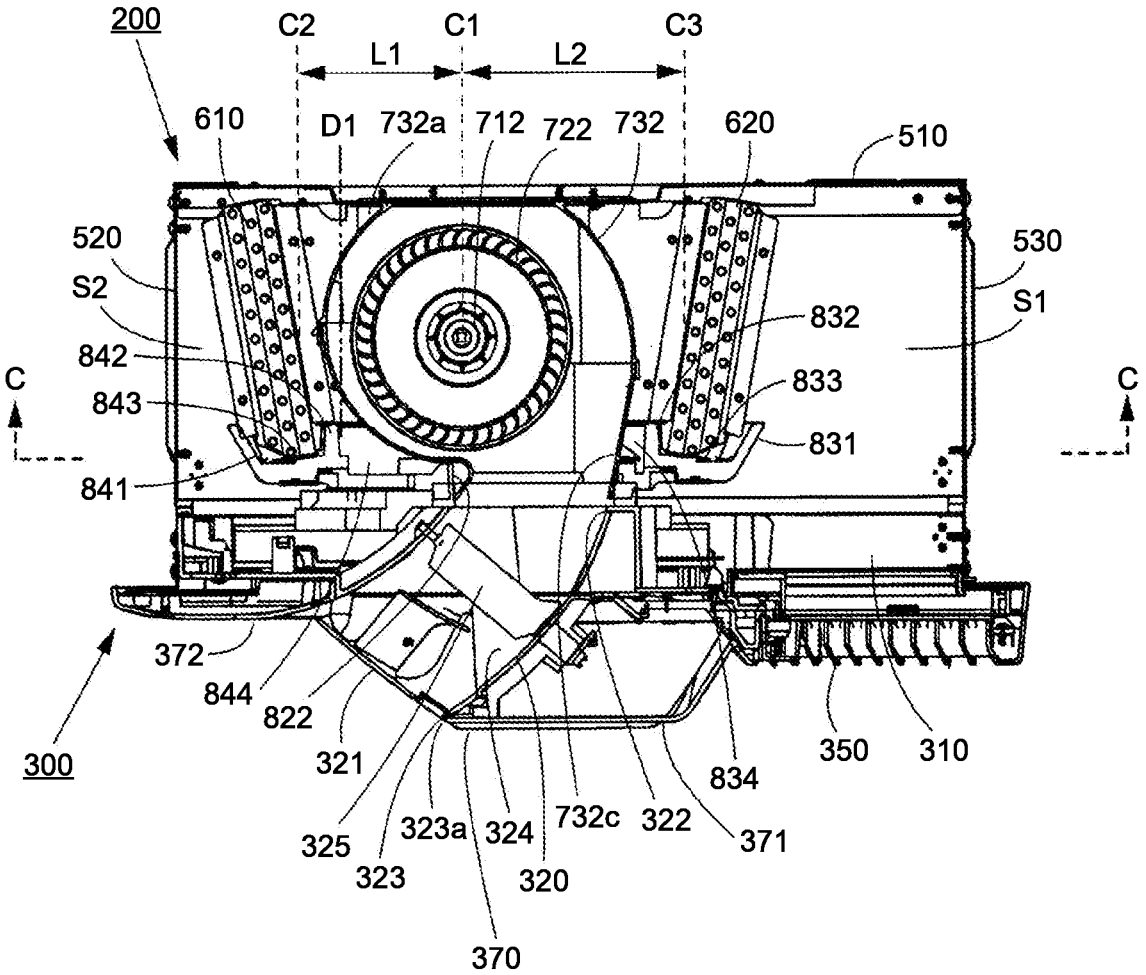
FIG. 7 is a sectional view across A-A in FIG. 2.

The outlet guide tube 320 will now be explained as an example. As illustrated in FIG. 7, the outlet guide tube 320 has a top opening 322 that communicates with the outlet tube 732*c* of the fan casing 732, on the outlet port opening 822 of the drain pan 800, a bottom opening 323 that is positioned facing diagonally downwards toward the front, and an outlet ventilation path 324 that extends from the top opening 322 to the bottom opening 323, and that is smoothly curved. The up-and-down wind deflector 321 shared with the outlet guide tube 330 is mounted on the bottom opening 323 serving as an outlet port opening. A right-and-left wind deflector 325 for the outlet guide tube 320 is also mounted on the outlet ventilation path 324 on the upper rear portion. A bottom end 323*a* of the bottom opening 323 protrudes more downwards than the front part 372 of the bottom surface 370 of the decorative panel 300 does. The same type of the right-and-left wind deflector, not illustrated, as the right-and-left wind deflector 325 is also mounted on an outlet ventilation path, not illustrated, in the outlet guide tube 330. Right-and-left wind deflectors, not illustrated, are also mounted on the leftmost outlet guide tube 310 and the rightmost outlet guide tube 340, respectively. The up-and-down wind deflectors 311, 341 are also provided rotatably by the rotations of the rotating plate 380, 390. However, because these parts are irrelevant to the present invention, detailed explanations thereof will be omitted.

Assembling of the ceiling-embedded air conditioner 100 will now be explained by referring to FIG. 4 as appropriate. To begin with, the housing 500 of the main unit 200 is placed on an assembly table with the top plate 510 facing upwards, and the assembled heat exchangers 610, 620 are then fixed onto the inner side of the top plate 510.

After positioning the assembled fan unit 700 between the heat exchangers 610, 620, the motor mount 711 of the fan motor 710 is fixed to the top plate 510 with screws. The one motor rotational shaft 712 is then supported on the motor shaft support plate 630, and the other motor rotational shaft 713 is then supported on the motor shaft support plate 640. The top mounts 731*a* to 734*a* of the respective fan casings 731 to 734 are then screwed onto the top plate 510.

At this time, as illustrated in FIG. 7, the fan unit 700 is placed nearer to the first heat exchanger 610 on the front side than to the second heat exchanger 620 on the rear side so that L1<L2 is established, denoting the distance between the center C1 of the motor rotational shafts 712, 713 of the fan unit 700 and a center C2 of the first heat exchanger 610 on the front side in the up-and-down direction as L1, and denoting the distance between C1 and a center C3 of the second heat exchanger 620 on the rear side in the up-and-down direction as L2.

The drain pump 900 is then attached to the inner side of the right plate 550 of the housing 500, and the discharge port 920 is joined to the drainpipe 551 illustrated in FIG. 3. After aligning the second heat exchanger 620 with the groove 833 provided on the top surface 810*a* of the drain pan 800, and aligning the first heat exchanger 610 with the groove 843, the drain pan 800 is pushed up from below so that the drain pan 800 fits inside of the housing 500, and the short piece 873 of the reinforcement metal piece 870 is fixed to the left plate 540 of the housing 500 with screws, and the attachment pieces 875, 876 are screwed onto the right plate 550. With the drain pan 800 mounted in the manner described, the rear end 810*c* faces a space S1, which will be described later, and the front end 810*d* faces a space S2, which will also be described later.

As a result of the steps described above, the outlet tubes 731*c* to 734*c* of the respective four fan casings 731 to 734 in the fan unit 700 get inside of the side walls 821*a* to 824*a* of the four outlet port openings 821 to 824, respectively, on the top surface 810*a* of the drain pan 800, and the outlet tubes 731*c* to 734*c* of the respective fan casings 731 to 734 come to communicate with the outlet port openings 821 to 824, respectively, on the drain pan 800. Furthermore, the intake port 910 of the drain pump 900 is positioned inside the drain tank 860 on the drain pan 800.

Because the assembled main unit 200 is packed separately from the decorative panel 300, when the ceiling-embedded air conditioner 100 is installed, the package is unpacked, and the main unit 200 is installed in the garret T2 by hanging the main unit 200 from a plurality of suspension bolts embedded in the garret T2. The decorative panel 300 is then attached from the side of the air-conditioned room R, as illustrated in FIG. 1. The top opening 322 of the outlet guide tube 320 provided on the decorative panel 300 is then inserted into the outlet port opening 822 from the bottom surface 810*b* of the drain pan 800, as illustrated in FIG. 7, so that the outlet guide tube 320 becomes communicative with the outlet tube 732*c* of the fan casing 732. The remaining outlet guide tubes 310, 330, 340 are also inserted into the respective outlet port openings 821, 823, 824 of the drain pan 800, so that the remaining outlet guide tubes 310, 330, 340 become communicative with the outlet tubes 731*c*, 733*c*, 734*c* of the fan casings 731, 733, 734, respectively. The decorative panel 300 is then fixed to the housing 500 of the main unit 200 with screws, and a refrigerant line, a power line, a signal line, and the like, not illustrated, are connected thereto.

Figure 8:
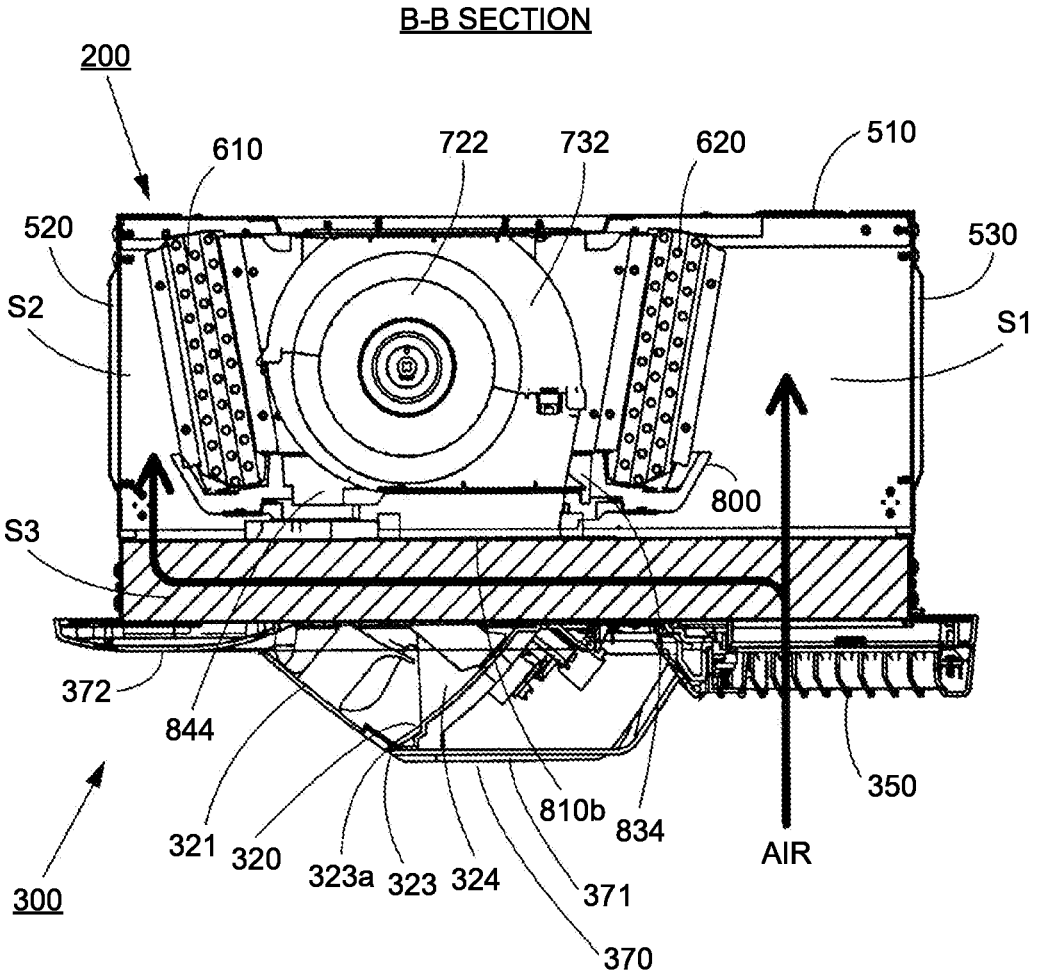
FIG. 8 is a sectional view across B-B in FIG. 2.
Figure 9:
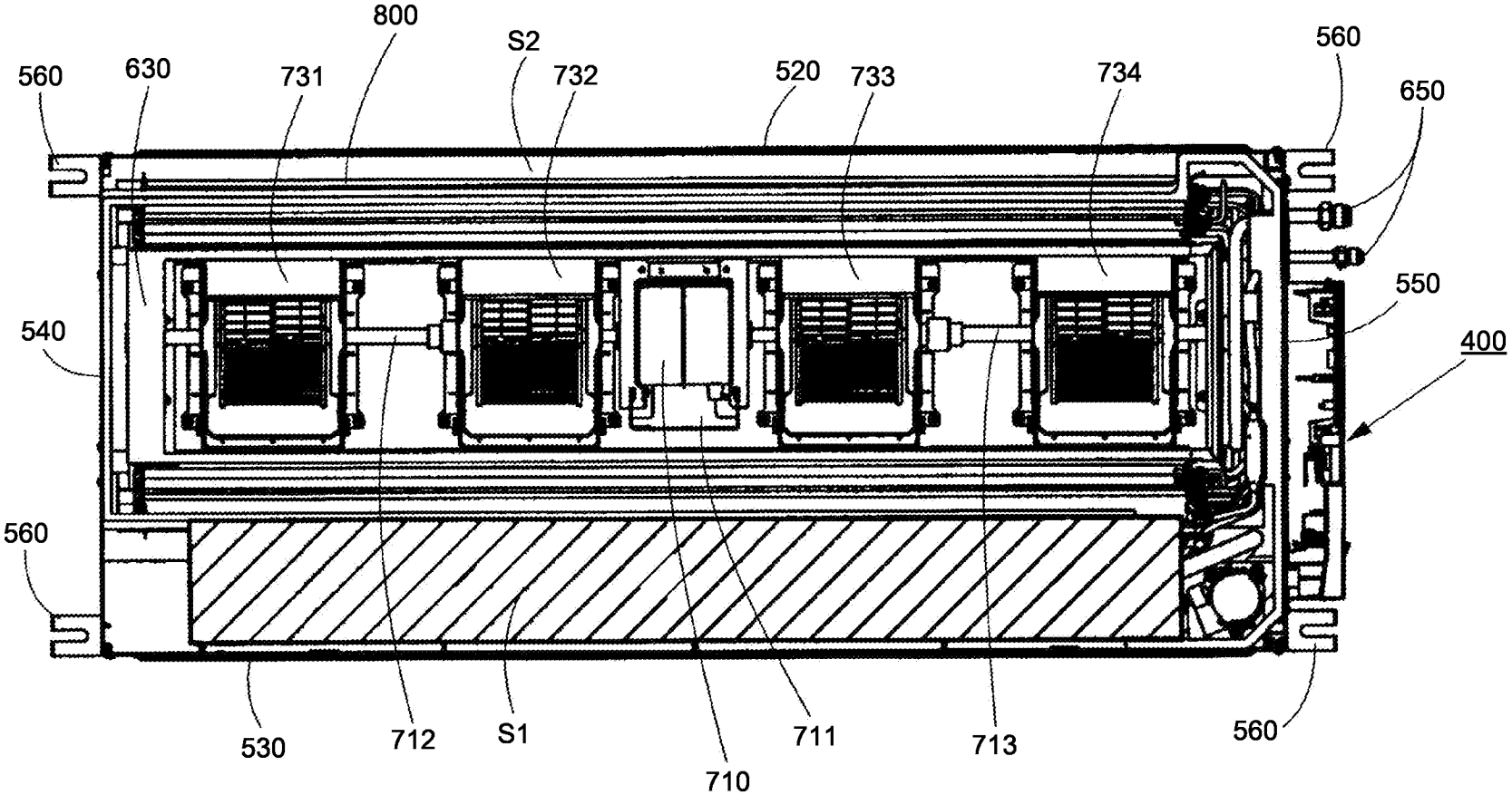
FIG. 9 is a sectional view along C-C in FIG. 7.
Figure 10:
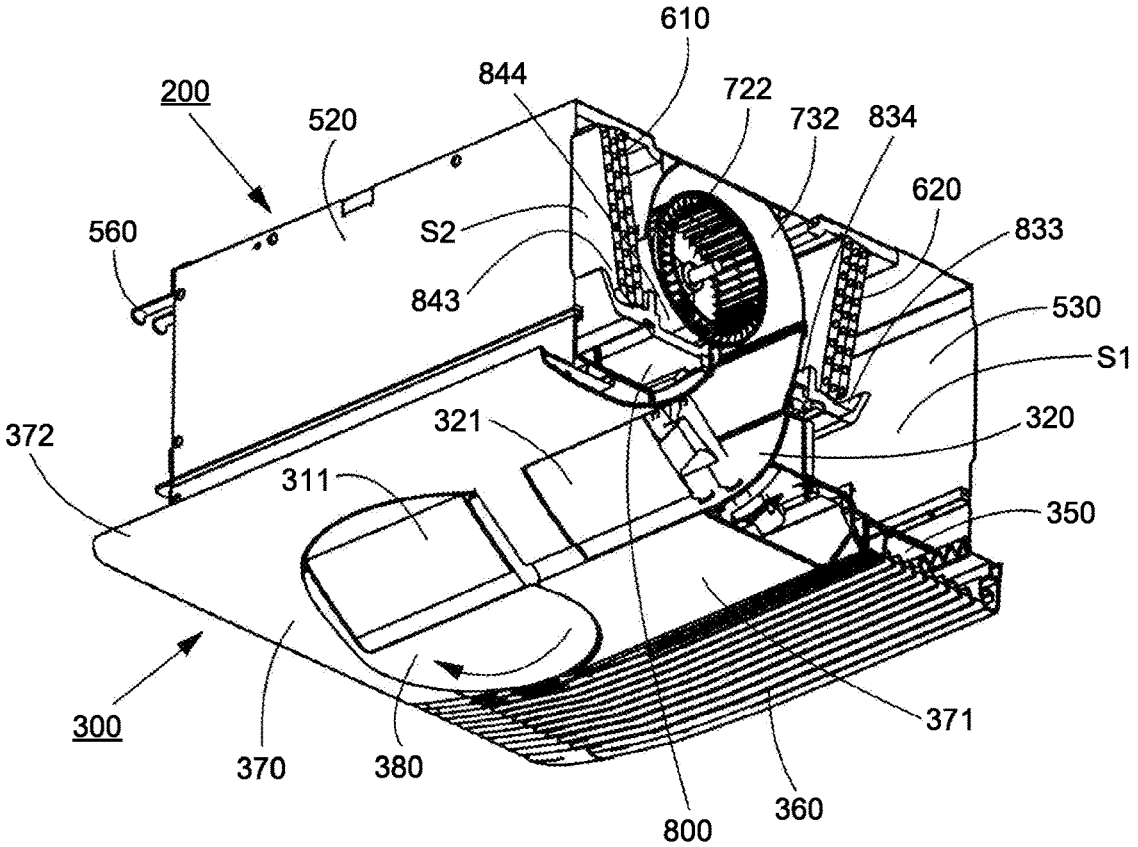
FIG. 10 is a perspective view illustrating an A-A section in FIG. 2.
Figure 11:
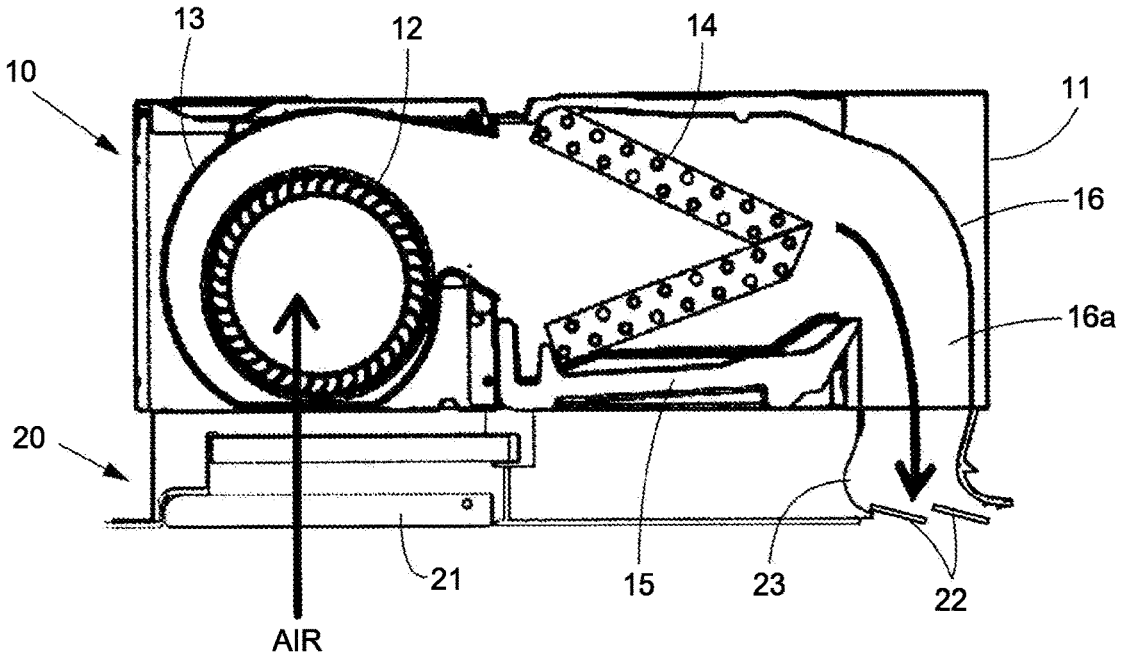
FIG. 11 is a general schematic illustrating a conventional ceiling-embedded air conditioner.
Figure 12:
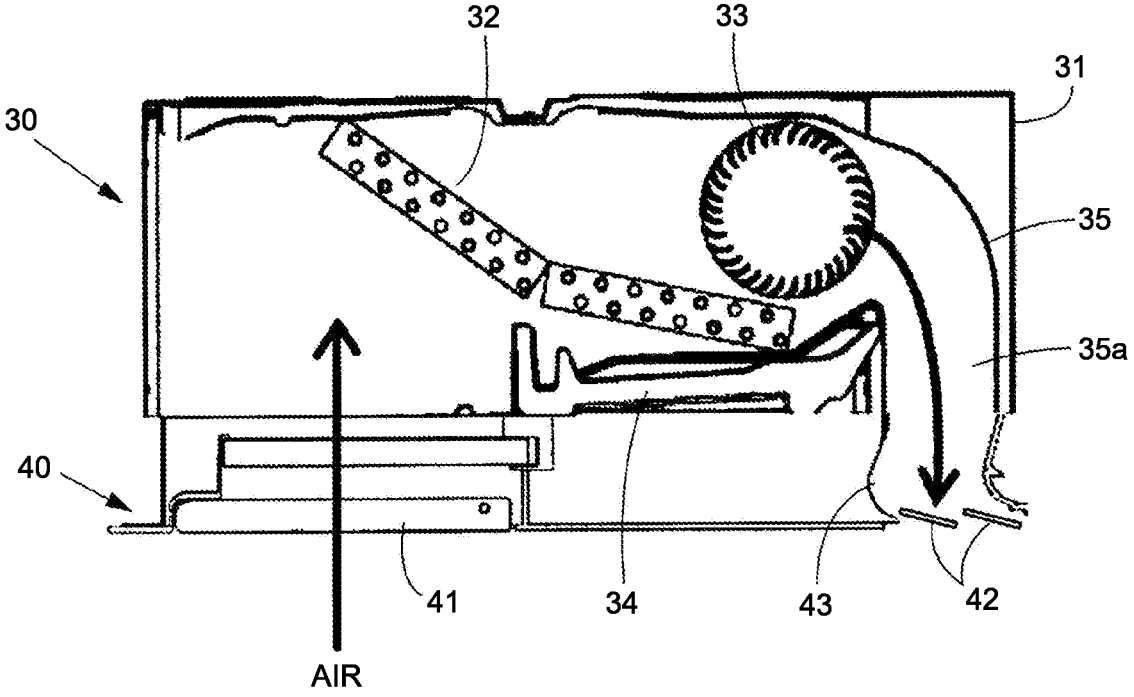
FIG. 12 is a general schematic illustrating another conventional ceiling-embedded air conditioner.

In the ceiling-embedded air conditioner 100 assembled in the manner described above, as illustrated in FIG. 8, the space S1 between the second heat exchanger 620 on the rear side and the rear plate 530 becomes communicative with the space S2 between the first heat exchanger 610 on the front side and the front plate 520 of the housing 500 through a space S3 between the bottom surface 810*b* of the drain pan 800 and the decorative panel 300. This space S3 not only serves as a space where the outlet guide tubes 310, 320, 330, 340 are positioned, but also serves as a space where the outlet guide tubes are connected to each other.

Based on the above, in the ceiling-embedded air conditioner 100 according to the embodiment, the outlet guide tube 320 has the bottom opening 323 with a bottom end 232*a* thereof protruding more downwards than the front part 372 of the bottom surface 370 of the decorative panel 300 does, and the bottom opening 323 has an opening plane facing diagonally downwards toward the front. Furthermore, the outlet ventilation path 324 is smoothly curved toward the direction below the front plate 520. Therefore, the outlet guide tube 320 is less likely cause volume loss in the air that the rotating impeller 722 blows, and it becomes possible to extend the reachable distance of the outgoing air flow in a frontward direction with respect to the ceiling-embedded air conditioner 100. The same is applicable to the outlet guide tubes 310, 330, 340.

The air collected from the intake port 350 of the decorative panel 300 reaches the second heat exchanger 620 through the space S1 provided between the second heat exchanger 620 on the rear side and the rear plate 530. The air collected from the intake port 350 of the decorative panel 300 reaches the first heat exchanger 610 on the front side via the space S3 and the space S2, the space S3 being formed between the bottom surface 810*b* of the drain pan 800 and the decorative panel 300 and between the outlet guide tubes 310, 320, 330, 340, the space S2 being formed between the front-side first heat exchanger 610 and the front plate 520. Therefore, a sufficient amount of air can be sent to the first heat exchanger 610, which is at a greater distance than the second heat exchanger 620 with respect to the intake port 350, and therefore, the same level of heat exchange be achieved by the first heat exchanger 610 as that achieved by the second heat exchanger 620, and hence, it becomes possible to improve the heat exchange efficiency of the ceiling-embedded heat exchangers. At this time, because the first heat exchanger 610 is inclined in such a manner that the upper side thereof is positioned near the front plate 520 of the housing 500, and the second heat exchanger 620 is inclined in such a manner that the upper side thereof is positioned near the rear plate 530 of the housing 500, and also because the air is collected into the spaces S1, S2 from below, the angle at which the direction of the incoming air is changed is increased from a right angle to a more gradual obtuse angle, so that the ventilation resistance is reduced, and the heat-exchange efficiency between the air and the refrigerant in the first and second heat exchangers 610, 620 is improved, compared with a configuration without the inclinations. Furthermore, by providing the inclinations to the first and the second heat exchangers 610, 620, the width of the heat exchangers in the up-and-down direction can be increased, compared with a configuration in which the heat exchangers are provided at a right angle. In this manner, it becomes possible to provide heat exchangers with a larger heat-exchanging surface areas, and the heat-exchange efficiency is also improved from this point of view.

Furthermore, as illustrated in FIG. 7, denoting the distance between the center C1 of the motor rotational shafts 712, 713 in the fan unit 700 and the center C2 of the first heat exchanger 610 in the up-and-down direction as L1, and denoting the distance between C1 and the center C3 of the second heat exchanger 620 in the up-and-down direction as L2, these distances are set so that L1<L2 is established. At this time, the outlet tubes 731*c* to 734*c* of the respective fan casings 731 to 734 are configured to face straight downwards, that is, to face the drain pan 800. Therefore, the outlet tubes 731*c* to 734*c* do not hit the first heat exchanger 610 or the second heat exchanger 620. Based on the above, it is possible to achieve an arrangement in which the fan unit 700 is positioned nearer to the first heat exchanger 610 than to the second heat exchanger 620, and as a result, the volume of the air sucked into the first heat exchanger 610 positioned nearer to the fan unit 700 is increased. As a result, because the volume of the air sucked into the first heat exchanger 610 is set larger than that sucked into the second heat exchanger 620, compared with a configuration in which L1=L2, it becomes possible even for the first heat exchanger 610, which has a longer airflow path than that of the second heat exchanger 620, to achieve the same level of heat-exchange efficiency as that achieved by the second heat exchanger 620, and therefore, the balance is improved. In other words, by setting L1<L2, the volume of the air sucked into the first heat exchanger 610 is increased, and the balance of the heat-exchange efficiency between the first heat exchanger 610 and the second heat exchanger 620 is improved. Furthermore, if L2 is set in the same manner as that conventionally practiced, because the first heat exchanger 610 is positioned nearer to the rear plate 530 of the housing 500, it is possible to position the front plate 520 of the housing 500 nearer to the rear plate 530, and the size of the housing 500 in the front-and-back direction can be reduced. Furthermore, when a part of the fan casings 731 to 734 of the fan unit 700 on the side of the first heat exchanger 610 is brought into abutment against the first heat exchanger 610, the part of the fan casings 731 to 734 facing the first heat exchanger 610 may be provided with a flat profile, by cutting along the line D1 illustrated in FIG. 7.

Furthermore, the fan casings 731 to 734 in the fan unit 700 are positioned in such a manner that the side walls of the outlet tubes 731*c* to 734*c* get inside of the side walls 821*a* to 824*a* of the outlet port openings 821 to 824, respectively, provided to the drain pan 800. The drain pan 800 has the groove 834 on the side of the side walls 821*a* to 824*a* with respect to the groove 833 for the second heat exchanger 620, and the groove 844 on the side of the side walls 821*a* to 824*a* with respect to the groove 843 for the first heat exchanger 610. Therefore, when dew drops become attached outside of the fan casings 731 to 734, the dew drops fall into and are received by the grooves 834, 844 on the drain pan 800. In this manner, it is possible to prevent the dew drops from falling into the room by following the outlet guide tubes 310, 320, 330, 340 of the decorative panel 300. Because only a slight amount of dew falls from the fan casings 731 to 734, the grooves 834, 844 do not communicate with the grooves 833, 843, but may also be provided communicatively.

Furthermore, the reinforcement metal piece 870 is mounted on the drain pan 800. The reinforcement metal piece 870 is integrated with the drain pan 800 by embedding the reinforcement metal piece 870 in the insulator material 810 of the drain pan 800 during the manufacturing process of the drain pan 800. This reinforcement metal piece 870 improves the strength of the drain pan 800 itself. Furthermore, although a reinforcement plate has been conventionally used to support the drain pan 800 from the bottom, because the reinforcement metal piece 870 is embedded in the drain pan 800 on the side of the bottom surface 810*b*, and supports the drain pan 800 from the bottom, such a reinforcement plate can be omitted. Furthermore, because the short piece 873 and the attachment pieces 875, 876 of the reinforcement metal piece 870 are screwed onto the housing 500, it is also possible to mount the drain pan 800, as well as to reinforce the housing 500, with these screws.

REFERENCE SIGNS LIST

100 ceiling-embedded air conditioner
200 main unit
300 decorative panel
310, 320, 330, 340 outlet guide tube
322 top opening
323 bottom opening
311, 321, 341 up-and-down wind deflector
350 intake port
360 grill
370 bottom surface
380, 390 rotating plate
400 electrical equipment box
500 housing
510 top plate
520 front plate
530 rear plate
540 left plate
550 right plate
560 attachment clamp
551 drainpipe
600 heat exchanger
610 first heat exchanger
620 second heat exchanger
630, 640 motor shaft support plate
700 fan unit
710 fan motor
721 to 724 impellor
731 to 734 fan casing
731*c* to 734*c* outlet tube
800 drain pan
810 insulator
821 to 824 outlet port opening
833, 834, 843, 844 groove
860 drain tank
870 reinforcement metal piece
900 drain pump

The invention claimed is:

1. A ceiling-embedded air conditioner comprising:
a main body; and
a decorative panel that includes an intake port and an outlet guide tube and is mounted on a bottom surface of the main body, wherein
the main body includes:
a box-shaped housing that has a top plate, a front plate, a rear plate, a left plate, and a right plate;
a heat exchanger that is disposed inside the housing;
a fan that is disposed inside the housing and includes a sirocco fan configured to collect air from the intake port and discharge the air from an outlet tube; and
a drain pan that is configured to collects dew drops formed on the heat exchanger and includes an outlet port opening through which the air discharged from the outlet tube of the sirocco fan passes toward the outlet guide tube of the decorative panel,
the outlet guide tube of the decorative panel includes:
a top opening that communicates with the outlet tube of the sirocco fan through the outlet port opening of the drain pan;
a bottom opening that faces a direction below the front plate of the main body; and
an outlet ventilation path that connects the top opening to the bottom opening and is curved, and
a bottom end of the bottom opening protrudes more downwards than a front part of the bottom surface of the decorative panel.

2. The ceiling-embedded air conditioner according to claim 1, wherein in the decorative panel,
the intake port is covered by a grill, and
a portion of the decorative panel between the grill and the bottom end of the bottom opening of the outlet guide tube protrudes downwards.

3. The ceiling-embedded air conditioner according to claim 1, wherein an opening plane of the bottom opening of the outlet guide tube faces diagonally downwards toward a front.

* * * * *